US010415266B2

(12) United States Patent
Alexander et al.

(10) Patent No.: US 10,415,266 B2
(45) Date of Patent: Sep. 17, 2019

(54) DOOR WITH ADJUSTABLE LOCK PLATE CONNECTORS

(71) Applicants: Markam R. Alexander, Dowagiac, MI (US); Leo R. Flory, Decatur, MI (US); Andrew J. Seiser, Schoolcraft, MI (US)

(72) Inventors: Markam R. Alexander, Dowagiac, MI (US); Leo R. Flory, Decatur, MI (US); Andrew J. Seiser, Schoolcraft, MI (US)

(73) Assignee: SPECIAL-LITE, INC., Decatur, MI (US)

( * ) Notice: Subject to any disclaimer, the term of this patent is extended or adjusted under 35 U.S.C. 154(b) by 1173 days.

(21) Appl. No.: 14/618,323

(22) Filed: Feb. 10, 2015

(65) Prior Publication Data

US 2016/0230419 A1 Aug. 11, 2016

(51) Int. Cl.
*E05B 9/00* (2006.01)
*E05B 9/08* (2006.01)

(52) U.S. Cl.
CPC ..... *E05B 9/002* (2013.01); *E05B 9/08* (2013.01)

(58) Field of Classification Search
CPC ..... E05B 2/002; E05B 2/08
See application file for complete search history.

(56) References Cited

U.S. PATENT DOCUMENTS 1,587,771 A * 6/1926 Goddard ..... E05B 9/08 292/DIG. 33
3,107,113 A 10/1963 Sconzo
3,834,101 A * 9/1974 Wilder ..... E06B 3/78 428/122
4,080,813 A * 3/1978 McKann ..... E05B 9/08 70/450
4,305,611 A 12/1981 Robins
4,453,752 A 6/1984 McKann
4,752,517 A * 6/1988 Beitel ..... E06B 3/78 156/70
5,118,151 A 6/1992 Nicholas, Jr. et al.
5,577,363 A * 11/1996 Tate ..... B29C 44/1233 52/309.11
6,491,326 B1 * 12/2002 Massey ..... E05C 1/04 292/162
6,962,031 B2 * 11/2005 Clarke ..... E05D 5/023 52/309.9
7,000,959 B2 * 2/2006 Sanders ..... E05B 15/0245 292/340
7,207,608 B2 * 4/2007 Monts de Oca .... E05B 15/0245 292/341.18
7,971,394 B1 * 7/2011 Dowling ..... E06B 3/70 49/506

(Continued)

FOREIGN PATENT DOCUMENTS

FR 2 962 469 A1 1/2012

OTHER PUBLICATIONS

Mesker Sales Sheet entitled Replacement and Retrofit Products Mesker FIT Adjustable Frame, dated Dec. 16, 2011 (1 page).

*Primary Examiner* — Catherine A Kelly
(74) *Attorney, Agent, or Firm* — Flynn Thiel, P.C.

(57) ABSTRACT

A door with adjustable lock connection hardware is provided. The lock connection hardware is movable to allow desired positioning of lock hardware without the need for drilling extra holes or other laborious action.

16 Claims, 8 Drawing Sheets

(56) References Cited

U.S. PATENT DOCUMENTS

| | | | | |
|---|---|---|---|---|
| 8,869,454 | B2 * | 10/2014 | Griffin, Jr. | E05B 9/002 49/460 |
| 2005/0127692 | A1 * | 6/2005 | Sanders | E05B 15/0245 292/340 |

* cited by examiner

DOOR WITH ADJUSTABLE LOCK PLATE CONNECTORS

BACKGROUND OF THE INVENTION

The invention herein generally relates to doors, and more specifically relates to doors with adjustable connectors for lock and latch faces.

While many doors are constructed in similar fashion, the height from the floor at which a plunger strikes the striker plate and into the striker plate opening and the height at which a deadbolt enters an opening may vary from door to door.

Thus, it would be useful to have an easily adjustable lock height on a door to increase the versitility and decrease the labor involved in installing a door, especially in an industrial or commercial setting.

The door of the present invention provides such an adjustability.

In one embodiment, a door comprises a front face, a rear face opposite to the front face, a first stile defining a first side edge and connecting the rear face to the front face, and a second stile defining a second side edge and connecting the rear face to the front face. The second side edge has an aperture in it. A flange is positioned at least partially between the front face and the rear face, and the flange has at least one support member and a leg extending inwardly from the support member. The second side edge and the leg together define a channel. At least one lock connection member is slidably engaged with the flange and has a slider portion at least partially residing within the channel and a connection portion exposed through the aperture in the second side edge. The connection portion is configured for connection to a lock.

In another embodiment, a door comprises a front face sheet, a rear face sheet spaced from the front face sheet, and an edge member in contact with both the front face sheet and the rear face sheet. The edge member comprises a lengthwise base, a first elongated extension extending from the base and being in contact with the front face sheet, and a second elongated extension extending from the base and being in contact with the rear face sheet. The first extension has an inwardly extending first leg which together with the base defines a first inner channel, the second extension having an inwardly extending second leg which together with the base forms a second inner channel. A lock connection member is provided and is slidably engaged with each of the first inner channel and the second inner channel, and is configured to connect to a lock.

Yet another embodiment is a door comprising a unitary stile including an elongated base portion being substantially flat and defining a longitudinal axis, a width axis, a first side end, and a second side end, a first outer projection adjacent the first side end and extending in a direction transverse to the width axis, a second outer projection adjacent the second side and extending in a direction transverse to the width axis, a first extension extending in a direction transverse to the width axis, a second extension spaced from the first extension and extending in a direction transverse to the width axis, the first outer projection and the first extension together defining a first outer channel configured to receive a door face member, the second outer projection and the second extension together defining a second outer channel configured to receive a door face member, a first leg attached to and extending inwardly from the first extension, the first leg and the base portion defining a first inner channel, and a second leg attached to and extending inwardly from the second extension, the second leg and the base portion together defining a second inner channel which opposes the first inner channel. The door further comprises at least one connection member movable within the first inner channel and the second inner channel. The connection member is configured to attach to lock hardware.

Other advantages, objects and/or purposes of the invention will be apparent to persons familiar with constructions of this general type upon reading the following specification and inspecting the accompanying drawings.

DETAILED DESCRIPTION OF THE PREFERRED EMBODIMENTS

Figure 1:
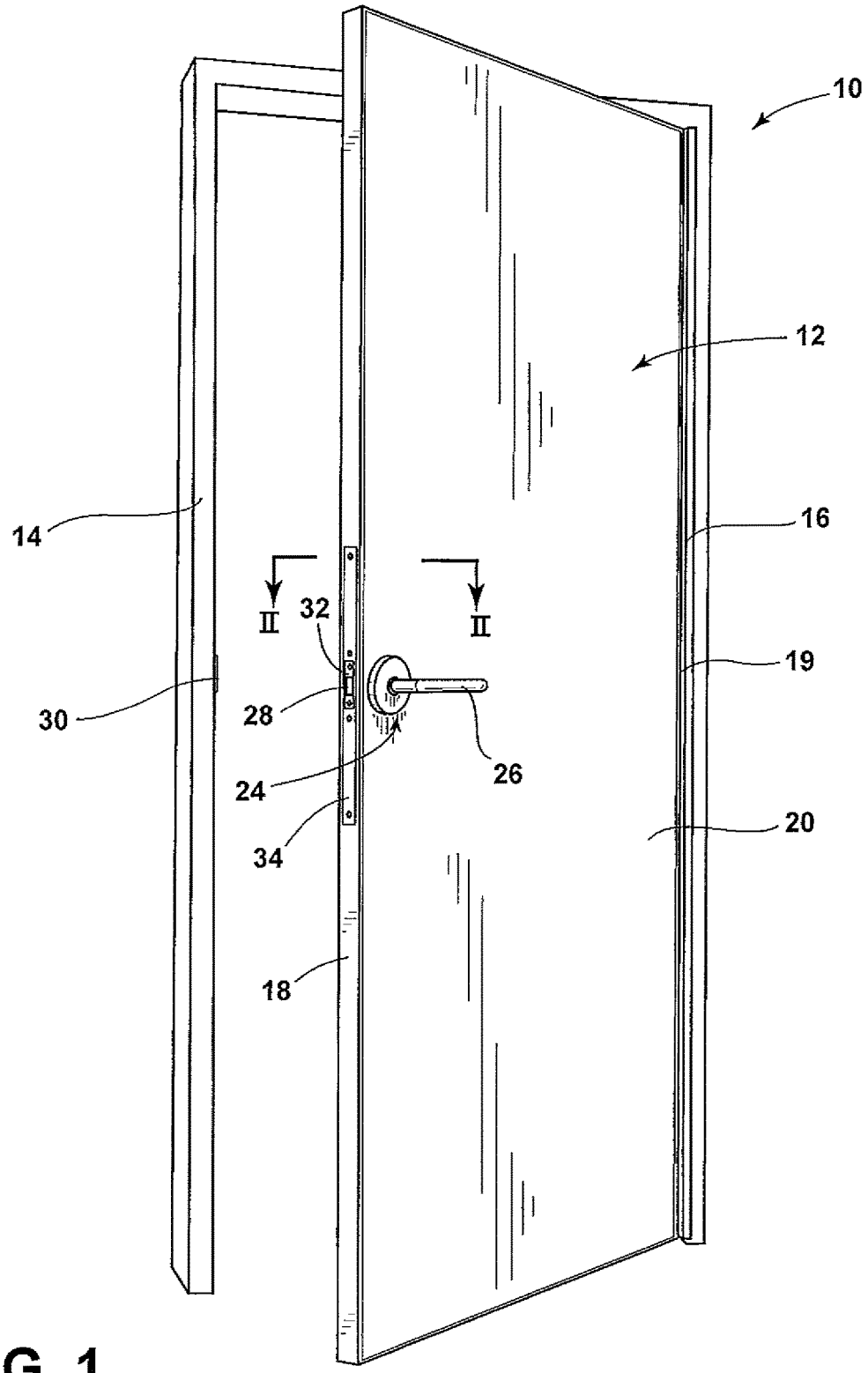
FIG. 1 is a perspective view of a door system that includes a frame and a door that embodies the present invention.

Certain terminology will be used in this description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the door arrangement and designated parts thereof. This terminology will include the words specifically mentioned, derivatives thereof, and words of similar import.

The terms "lock" or "latch" herein will encompass any kind of attachment or locking hardware that may be used with a door to connect the door to a frame or other adjacent structure. This will include, but is not limited to, locks, latches, and strikers.

As shown in FIG. 1, a door system 10 includes a door 12 and an adjacent frame 14 to which the door 12 is attached. The door system 10 includes one or more hinges 16 for attachment of the door 12 to the frame 14.

Figure 2:
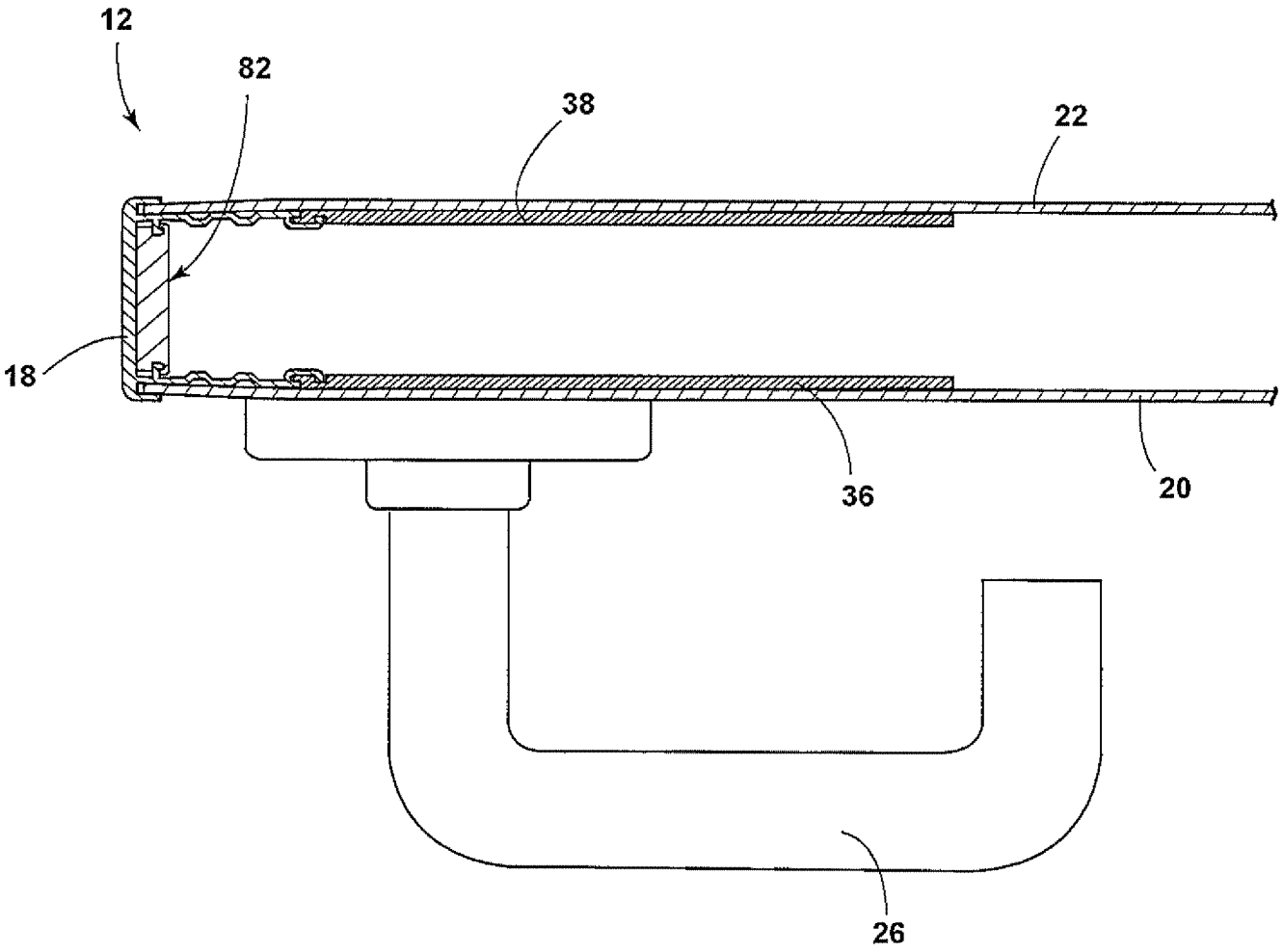
FIG. 2 is a partial cross-sectional view of the door of FIG. 1, taken along lines II-II in FIG. 1.

The door 12 of this embodiment generally includes a first stile 18 defining a first edge of the door 12, a second stile 19 defining a second edge of the door 12, a front face sheet 20, a rear face sheet 22, and latch hardware 24 to facilitate opening and closing of the door, as well as latching and/or locking of the door 12 to the frame 14 (see FIGS. 1-2).

The latch hardware 24 as shown in FIGS. 1-2 includes a handle 26 which rotates to move a plunger 28. The plunger 28 is positioned and configured to engage with a striker plate 30 which has an aperture therein for receiving the plunger 28 when the door 12 is closed.

The plunger 28 is attached to the door 12 by use of a latch face 32, as shown in FIG. 1. One or more face plates 34 is also preferably used to cover up an aperture in the edge of stile 18, which is discussed in more detail below.

As shown in FIG. 2, the edge stile 18 is attached to both the front face sheet 20 and the rear face sheet 22. Also attached to the edge stile 18 are reinforcements 36, 38 for reinforcing at least a portion of the front face sheet 20 and the rear face sheet 22, respectively.

Figure 3:
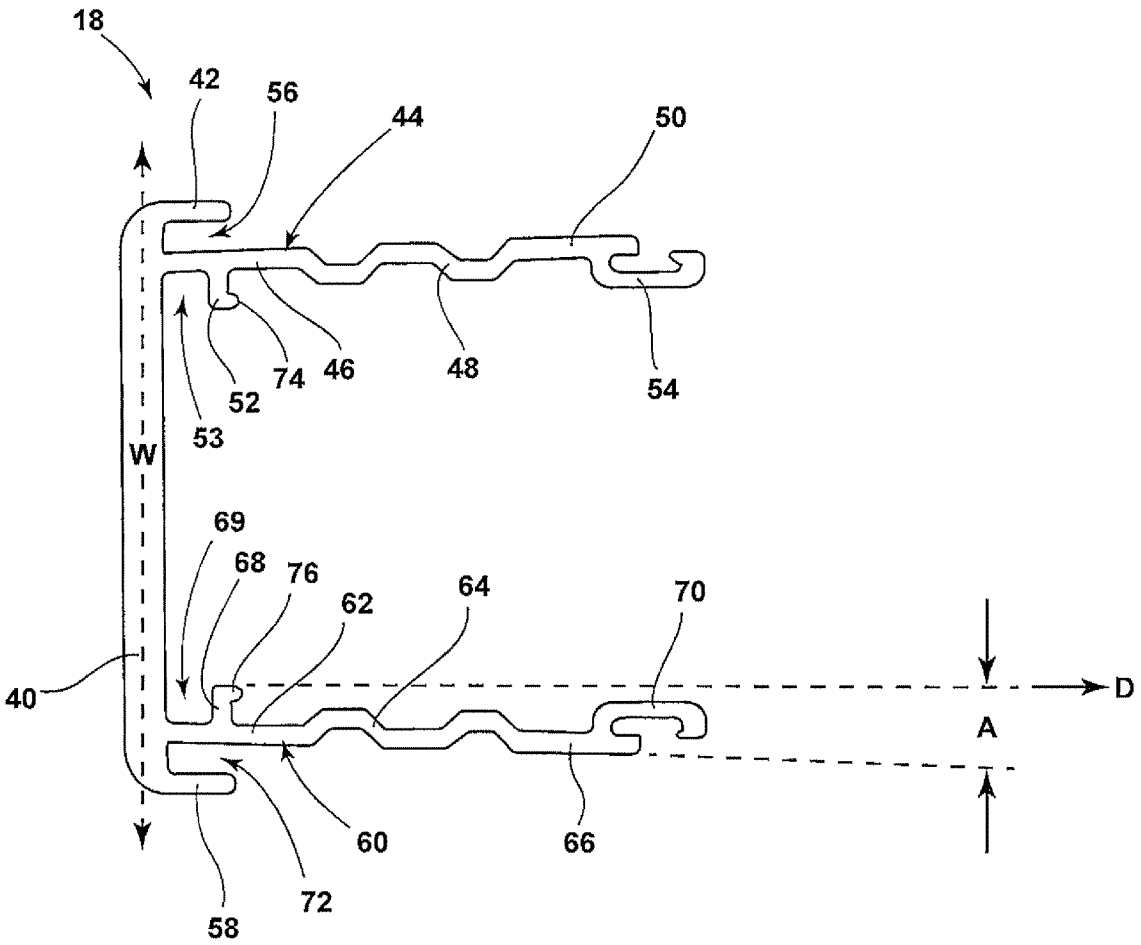
FIG. 3 is a top plan view of the stile of the door of FIG. 1.

As seen in FIG. 3, the edge stile 18 includes an elongated base 40 which extends the length, i.e. height, of the door and defines a longitudinal axis along the height of the door, as well as a width axis, depicted as W in FIG. 3, of the stile 18. The base 40 defines the edge of the stile 18 and thus the door 12. At one side of the stile 18 is a first outer projection 42, which extends in a direction substantially perpendicular, or at a few degrees offset from perpendicular to the width axis W. Spaced from but adjacent the first outer projection 42 is a first flange or extension 44. The first extension 44 also extends in a direction substantially perpendicular, or slightly offset from perpendicular, to the width axis W. The first extension 44 is positioned mostly between the front face sheet 20 and the rear face sheet 22 when the door is assembled (see FIG. 2).

The first extension 44 has a straight portion 46 which is connected to the base 40, a wavy portion 48 near the center of the first extension 44 and extending from the straight portion 46, and another straight portion 50 extending from the wavy portion 48. Extending inwardly from the straight portion 46 is a leg 52 and extending from the straight portion 50 is a reinforcement attachment member 54. The base 40, the straight portion 46 of the first extension 44, and the leg 52 together define a first inner channel 53 which is sized to receive a portion of a connection member.

The first outer projection 42 and the first extension 44, and in particular, the straight portion 46, together define a first outer channel 56. The channel 56 receives an edge portion of the rear face sheet 22.

On the opposite side of the stile 18 is a second outer projection 58 adjacent a second flange or extension 60. The second extension 60 is essentially a mirror image of the first extension 44. The second extension 60 is positioned mostly between the front face sheet 20 and the rear face sheet 22 when the door 12 is assembled (see FIG. 2). As such, the second extension 60 includes a straight portion 62 that is attached to the base 40, a wavy central portion 64 extending from the straight portion 62, and a second straight portion 66 extending from the wavy portion 64. The second extension 60 has a leg 68 extending inwardly therefrom, and in the general direction of the leg 52, and extends from the straight portion 62. The base 40, the straight portion 62, and the leg 68 together define a second inner channel 69 which is sized to receive a portion of a connection member. The second extension 60 also has a reinforcement attachment member 70 extending from the straight portion 66.

The second extension 60 is spaced from the second outer projection 58, which together define a channel 72 in which an edge portion of the front face sheet 20 resides.

Each of the legs 52, 68 extends inwardly and may be straight, but preferably has a rearwardly facing finger. The leg 52 has a finger 74 and the leg 68 has a finger 76. The fingers 74, 76 assist in retaining the connection members, which are discussed in more detail below.

Each of the reinforcement attachment members 54, 70 is generally C-shaped and is shaped and sized to receive and hold a portion of a reinforcement such as reinforcements 36, 38, which reinforce a portion of the door, adjacent the handle and/or lock.

The first extension 44 and the second extension 60 generally extend rearwardly in a direction D, shown in FIG. 3, which is perpendicular to the width axis W. However, preferably, the extensions 44, 60 are at a slight angle with respect to the direction D. This angle is depicted as A in FIG. 3 and is preferably between 0.5° and 3.5°, more preferably between 1° and 3°, and most preferably about 2°.

Figure 4A:
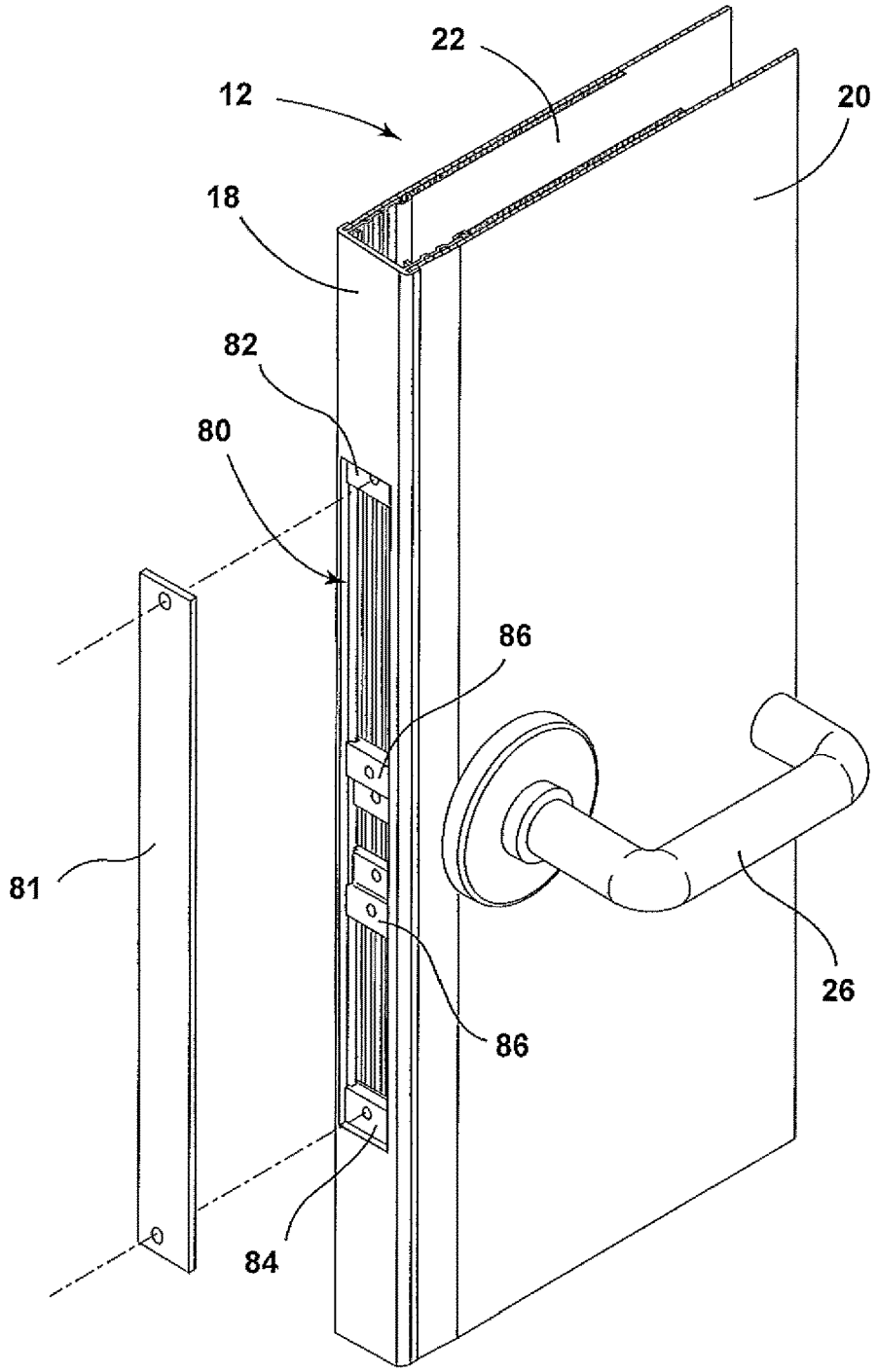
FIG. 4A is a partial exploded perspective view of the door of FIG. 1, depicting the initial face plate and how it is attached to the door.
Figure 4C:
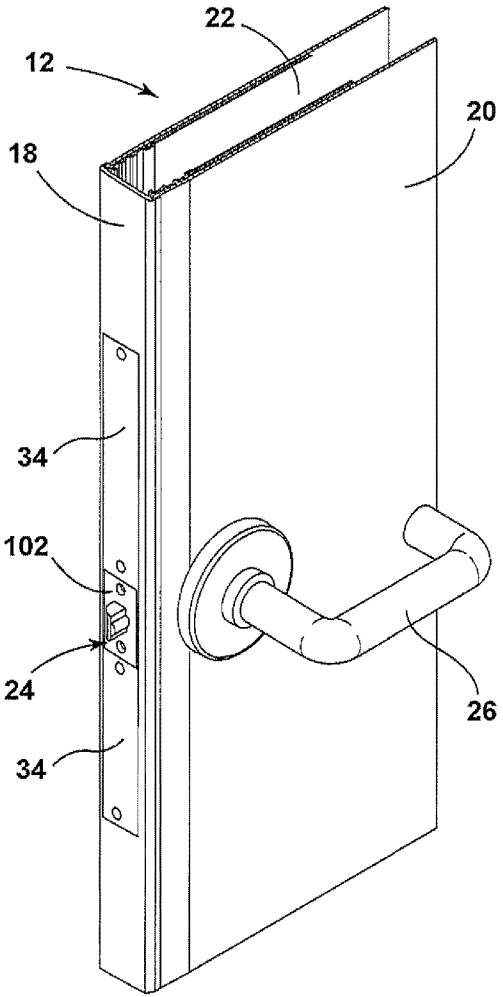
FIG. 4C is a partial perspective view of the door of FIG. 1, depicting the latch hardware and final face plates attached.
Figure 4B:
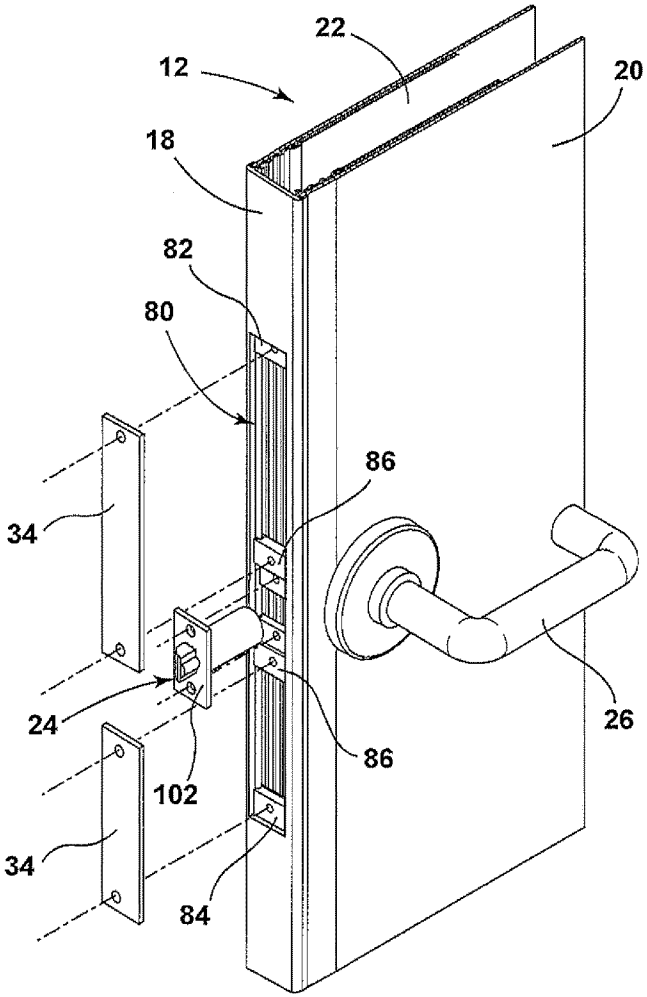
FIG. 4B is a partial exploded perspective view of the door of FIG. 1, depicting the lock and connection hardware, including lock blocks.

FIGS. 4A, 4B, and 4C show the attachment of the lock 24 to the door 12. The stile 18 has an aperture 80 in the base 40. The aperture 80 is located at a position at which a lock will be attached. When delivered, a long initial face plate 81 is attached to the door 12 and completely covers the aperture 80. The initial face plate 81 is preferably attached by screws to stationary lock blocks, discussed below, and can be removed to gain access to the connection hardware for connecting a latch face to the door 12.

In the embodiment shown in FIGS. 4A-4C, the door includes a top stationary connection member such as a lock block 82 which is located adjacent the top edge of the aperture 80, and a bottom stationary connection member such as a lock block 84 which is positioned adjacent the bottom edge of the aperture 80. The lock blocks 82, 84 preferably have attachment means such as threaded apertures therein. Also provided are two movable lock blocks 86. The lock blocks 86 are movable both with respect to the stationary lock blocks 82, 84 as well as each other. The lock blocks are connected to the stile 18 as shown in FIG. 2. A portion of each lock block fits within the channels 53, 69. The stationary lock blocks 82, 84 are fixedly attached to the stile 18 in any conventional manner. The movable lock blocks 86 are not fixedly attached but are slidable within the channels 53, 69, and may move only minimally in the directions of the W axis and D axis.

Figure 5:
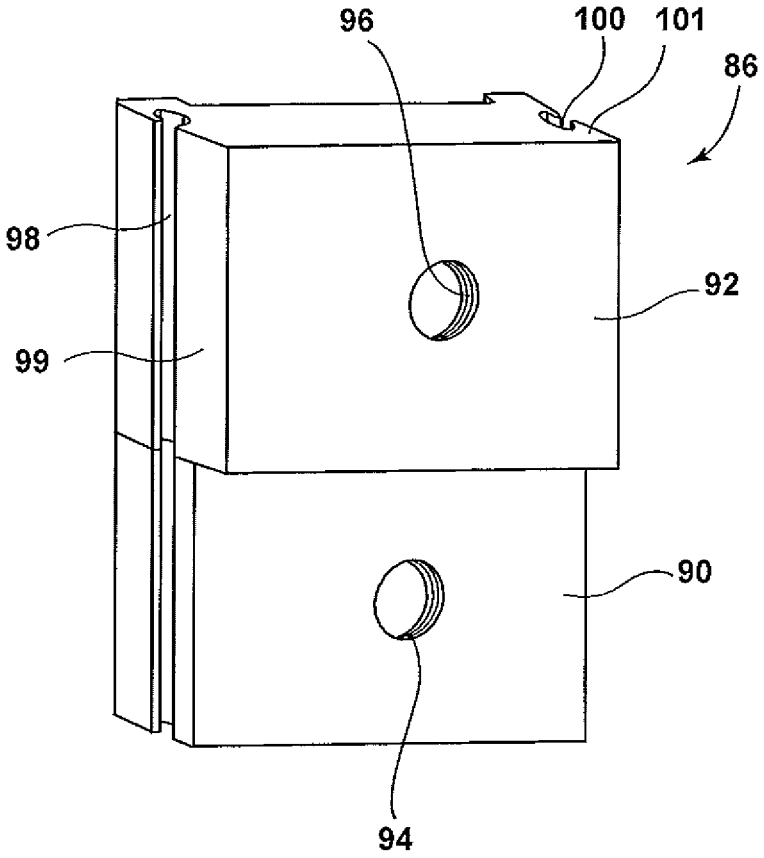
FIG. 5 is a perspective view of a lock block of the door of FIG. 1.
Figure 6:
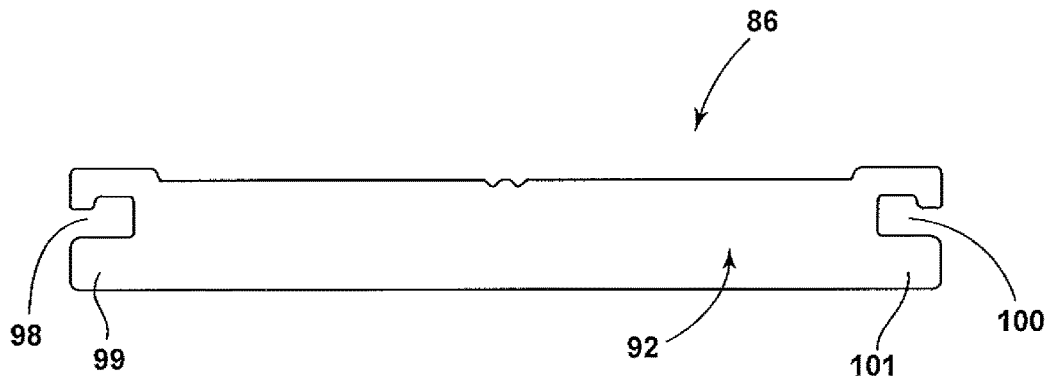
FIG. 6 is a top plan view of the lock block of FIG. 5.

Each of the movable lock blocks 86 has a first portion 90 and a deeper or thicker second portion 92. The first portion 90, shown as the lower portion in FIG. 5, contains an attachment means such as a threaded aperture 94 for attachment to a lock hardware such as a latch face. The second portion 92 also includes attachment means such as a threaded bore 96 for attachment to the face plate 34. As shown in FIGS. 5 and 6, the lock blocks 86 include opposing grooves 98, 100 which are generally in the shape of the legs 52, 68 such that the grooves 98, 100 engage the legs 52, 68 and slide therealong. On one side of each groove is a slide-portion 99, 101. The legs 52, 68 help retain the lock blocks 86 and at the same time allow longitudinal movement.

Figure 7:
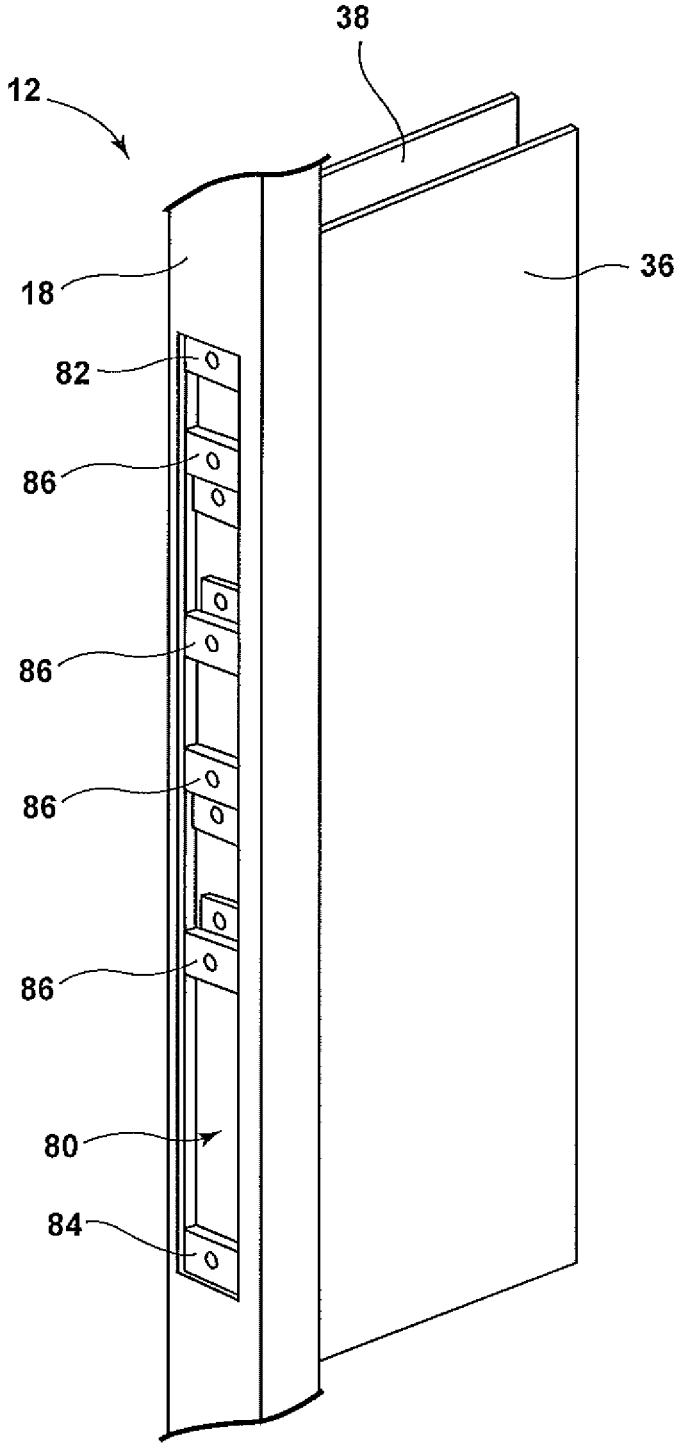
FIG. 7 is a partial perspective view of an alternative embodiment of the door of FIG. 1, depicting four movable lock blocks.

It is contemplated that the door 12 may have more than two movable lock blocks 86. In an alternative embodiment, the door 12 has four movable lock blocks 86, in addition to the top stationary lock block 82 and the bottom stationary lock block 84 (see FIG. 7). This will allow attachment of both a plunger and a lock such as a deadbolt, for instance.

In operation, the main structure of the door is assembled by attaching lock blocks 82, 84, and 86 to the stile 18, attaching reinforcements 36, 38 to the stile 18, and attaching the front face sheet 20 and the rear face sheet to the stile 18. The additional stile 19 is also attached to the door 12 to connect the front face sheet 20 to the rear face sheet 22. The extension 44 is in contact with the rear face plate 22 and the extension 60 is in contact with the front face plate 20. The initial face plate 81 is attached to lock blocks 82, 84 to cover the aperture 80, and the door 12 is ready for shipment.

Either before hanging or after hanging the door 12, it is determined at what height the lock hardware 24 needs to be or is desired to be positioned. The initial face plate 81 is removed from the door by unscrewing it from the lock blocks 82, 84. The movable lock blocks 86 are positioned accordingly, by sliding if necessary to the desired positions. The lock hardware 24 is then attached to the movable lock blocks 86, specifically by attachment of a latch face 32 to the threaded bore 94 of the first portion 90 of two separate lock blocks 86 (see FIG. 4A). The front 102 of the latch face 32 remains exposed. The initial face plate 81 is then sized by cutting into one or more face plates 34 and additional holes are drilled for attachment of the face plates 34 to the lock blocks 82, 84, 86. The face plate 34, in one or more parts, is then attached to a movable lock block 86 and a stationary lock block, such as the top stationary lock block 82, to cover the remainder of the aperture 80. The handle 26 and any other necessary hardware is then attached and the door 12 is ready for use.

The door 12 can be relatively inexpensively made, while giving the versatility of and ease of adjustment of the height of the lock to installers.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A door comprising:

a front face;

a rear face oppositely oriented with respect to the front face;

a first stile defining a first side edge and connecting the rear face to the front face;

a second stile having a base and a flange, the base defining a second side edge and connecting the rear face to the front face, the base having an aperture therein;

the flange positioned at least partially between the front face and the rear face, the flange having a support member and a leg attached to and extending inwardly from the support member and disposed entirely interiorly with respect to the base, the base and the leg together defining a channel; and at least one lock connection member slidably engaged with the flange and having a slider portion at least partially residing within the channel and a connection portion exposed to the exterior of the door through the aperture in the second side edge, the connection portion configured for connection to a lock.

2. The door of claim 1, wherein the base and the flange are connected.

3. The door of claim 1, wherein the flange is a first flange, and the door further comprises a second flange spaced from the first flange and positioned at least partially between the front face and the rear face.

4. The door of claim 3, wherein the second flange comprises a second support member and a second leg extending inwardly from the second support member.

5. The door of claim 3 wherein the first flange and the second flange are both connected to the base.

6. A door comprising:

a front face sheet;

a rear face sheet spaced from the front face sheet;

an edge member comprising a base having a length and disposed in a widthwise direction, a first elongated extension extending from the base and being in contact with the front face sheet, and a second elongated extension extending from the base and being in contact with the rear face sheet, the first extension having a first leg extending substantially in the widthwise direction which together with the base defines a first inner channel, the second extension having a second leg extending substantially in the widthwise direction which together with the base forms a second inner channel, the first leg and the second leg separated from each other; and a lock connection member slidably engaged with each of the first inner channel and the second inner channel, the connection member configured to connect to a lock.

7. The door of claim 6, wherein the lock connection member is a first lock connection member and the door further comprises a second lock connection member slidably engaged with each of the first inner channel and the second inner channel.

8. The door of claim 7, wherein the first lock connection member and the second lock connection member are movable relative to each other.

9. The door of claim 6, wherein the first extension and the second extension each have a reinforcement attachment member configured to be connected to a reinforcement.

10. The door of claim 9, and further comprising at least one reinforcement connected to the reinforcement attachment member of one of the first extension and the second extension.

11. A door comprising:

a unitary stile member including:

an elongated base portion which is substantially flat and defining a longitudinal axis, a width axis, a first side end, and a second side end, a first outer projection adjacent the first side end and extending in a direction substantially transverse to the width axis, a second outer projection adjacent the second side end and extending in a direction substantially transverse to the width axis, a first extension extending in a direction substantially transverse to the width axis, a second extension spaced from the first extension and extending in a direction substantially transverse to the width axis, the first outer projection, the base portion and the first extension together defining a first outer channel configured to receive a door face member, the second outer projection, the base portion, and the second extension together defining a second outer channel configured to receive a door face member, a first leg attached to and extending inwardly from the first extension, the first leg and the base portion defining a first inner channel, a second leg attached to and extending inwardly from the second extension, the second leg and the base portion together defining a second inner channel which opposes the first inner channel; and at least one connection member movable within the first inner channel and the second inner channel, the connection member configured to attach to lock hardware.

12. The door of claim 11, wherein the elongated base has an aperture therein.

13. The door of claim 12, wherein the at least one connection member can be attached to lock hardware through the aperture.

14. The door of claim 13, further including a stationary lock connection member.

15. The door of claim 11, further including at least one initial face plate attached to the at least one connection member, the initial face plate configured to be re-sized for re-attachment to the door when the latch hardware is installed.

16. The door of claim 11, and further comprising a stationary lock connection member.

* * * * *